US011194289B1

(12) United States Patent
Bui

(10) Patent No.: US 11,194,289 B1
(45) Date of Patent: Dec. 7, 2021

(54) IMAGE FORMING APPARATUS

(71) Applicant: KYOCERA Document Solutions Inc., Osaka (JP)

(72) Inventor: Dang Long Bui, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/335,272

(22) Filed: Jun. 1, 2021

(30) Foreign Application Priority Data

Jun. 2, 2020 (JP) ..... JP2020-096129

(51) Int. Cl.

| | |
|---|---|
| ***G03G 21/20*** | (2006.01) |
| ***G03G 21/16*** | (2006.01) |
| ***G03G 21/00*** | (2006.01) |
| ***G03G 15/01*** | (2006.01) |

(52) U.S. Cl.
CPC ..... *G03G 21/206* (2013.01); *G03G 15/0142* (2013.01); *G03G 21/0052* (2013.01); *G03G 21/1604* (2013.01); *G03G 21/1619* (2013.01); *G03G 21/1666* (2013.01); *G03G 21/1695* (2013.01); *G03G 2215/00016* (2013.01); *G03G 2221/1645* (2013.01)

(58) Field of Classification Search
CPC ..... G03G 15/0142; G03G 15/1666; G03G 15/1695; G03G 21/0052; G03G 21/1604; G03G 21/1619; G03G 21/206; G03G 2215/00016; G03G 2221/1645
See application file for complete search history.

(56) References Cited

U.S. PATENT DOCUMENTS

| | | | | |
|---|---|---|---|---|
| 2014/0003833 | A1* | 1/2014 | Asakawa | G03G 21/206 399/92 |
| 2015/0139685 | A1* | 5/2015 | Hoshino | G03G 21/1619 399/107 |
| 2020/0103823 | A1* | 4/2020 | Tanaka | G03G 21/206 |

FOREIGN PATENT DOCUMENTS

| | | |
|---|---|---|
| JP | H02-93554 | 4/1990 |

* cited by examiner

*Primary Examiner* — Joseph S Wong
(74) *Attorney, Agent, or Firm* — Lex IP Meister, PLLC

(57) ABSTRACT

An image forming apparatus includes a casing in which multiple units are disposed. The casing has a front wall having a first opening and a stepped wall having a second opening. In the casing, an exposure unit is disposed in front of an image forming unit, above the first opening, and above a sheet loading section, and a fixing unit is disposed above the image forming unit. The exposure unit is disposed with a first gap between the exposure unit and the image forming unit, and the fixing unit is disposed with a second gap between the exposure unit and the image forming unit. The first gap and the second gap constitute a ventilation channel for distributing outside air flowing into the casing through the first opening to the second opening.

3 Claims, 6 Drawing Sheets

IMAGE FORMING APPARATUS

INCORPORATION BY REFERENCE

This application is based upon, and claims the benefit of priority from, corresponding Japanese Patent Application No. 2020-096129 filed in the Japan Patent Office on Jun. 2, 2020, the entire contents of which are incorporated herein by reference.

BACKGROUND

The disclosure relates to an image forming apparatus including multiple units disposed within a casing.

Typically, image forming apparatuses that form images on sheets are known to have a configuration in which multiple units, such as an image forming unit, an exposure unit, and a fixing unit, are arranged in a casing. In such a type of image forming apparatus, the temperature inside the casing rises due to heat generated by the driving of the units.

SUMMARY

An image forming apparatus according to one aspect of the disclosure includes a casing, a sheet loading section, an image forming unit, an exposure unit, and a fixing unit. The casing includes a side wall extending in an up-down direction and a first horizontal direction and having a first opening; an top wall comprising a top face and a sheet output portion, the top face connected to a top edge of the side wall, the sheet output portion being recessed from the top face and extending in a second horizontal direction orthogonal to the first horizontal direction; and a stepped wall extending upward from an edge of the sheet output portion on one side along the second horizontal direction, being connected to the top face, and having a second opening, the one side being opposite another side adjacent to the side wall. The sheet loading section is disposed in the casing facing the first opening and extends in the first horizontal direction and the second horizontal direction. A sheet is placed on the sheet loading section. The image forming unit is disposed in the casing above the sheet loading section and on the one side along the second horizontal direction. The image forming unit includes a photosensitive drum for forming an image on the sheet. The exposure unit is disposed in the casing at a position above the sheet loading section and above the first opening, on the other side of the image forming unit along the second horizontal direction with a specific first gap between the image forming unit and the exposure unit. The exposure unit irradiates the photosensitive drum with light. The fixing unit is disposed in the casing above the image forming unit and on the one side of the stepped wall along the second horizontal direction, with a specific second gap between the image forming unit and the fixing unit. The fixing unit heats and fixes an image on the sheet. The first gap and the second gap are set to a gap width that permits passage of outside air flowing into the casing through the first opening, and the first gap and the second gap comprise a ventilation channel that distributes the outside air to the second opening.

DETAILED DESCRIPTION

An image forming apparatus according to an embodiment of the disclosure will now be described with reference to the drawings. In the following description, the terms "up-down direction," "left-right direction," and "front-back direction" are used to describe directional relationships. The term "up-down direction" refers to the vertical direction; the term "the left-right direction" refers to a first horizontal direction in a horizontal plane orthogonal to the up-down direction; and the term "front-back direction" refers to a second horizontal direction in a horizontal plane orthogonal to the left-right direction. The forward side along the front-back direction corresponds to one side along the second horizontal direction, and the rear side along the front-back direction corresponds to another side opposite to the one side along the second horizontal direction.

Figure 1:
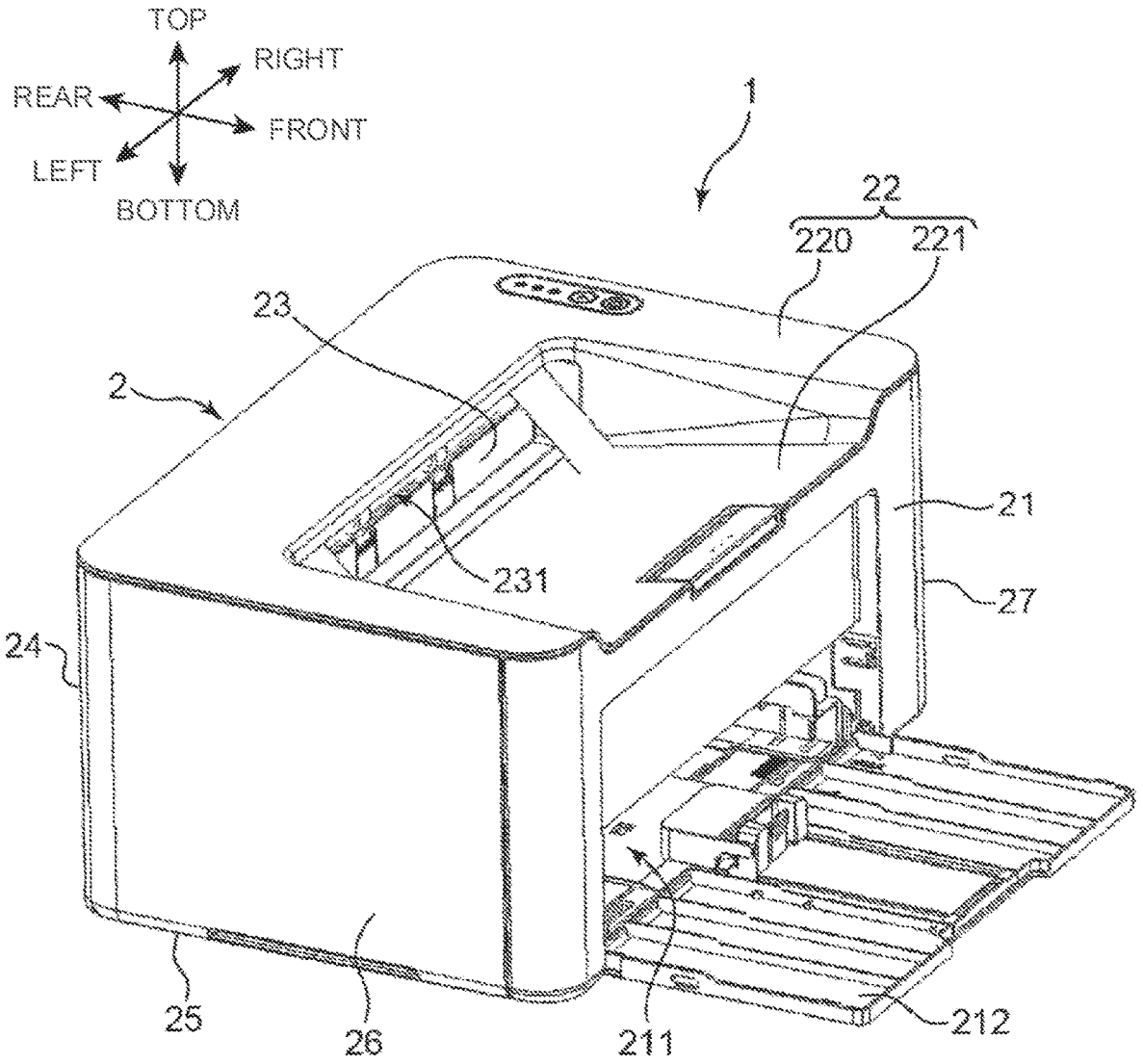
FIG. 1 is a perspective diagram illustrating an image forming apparatus according to an embodiment of the disclosure.
Figure 2:
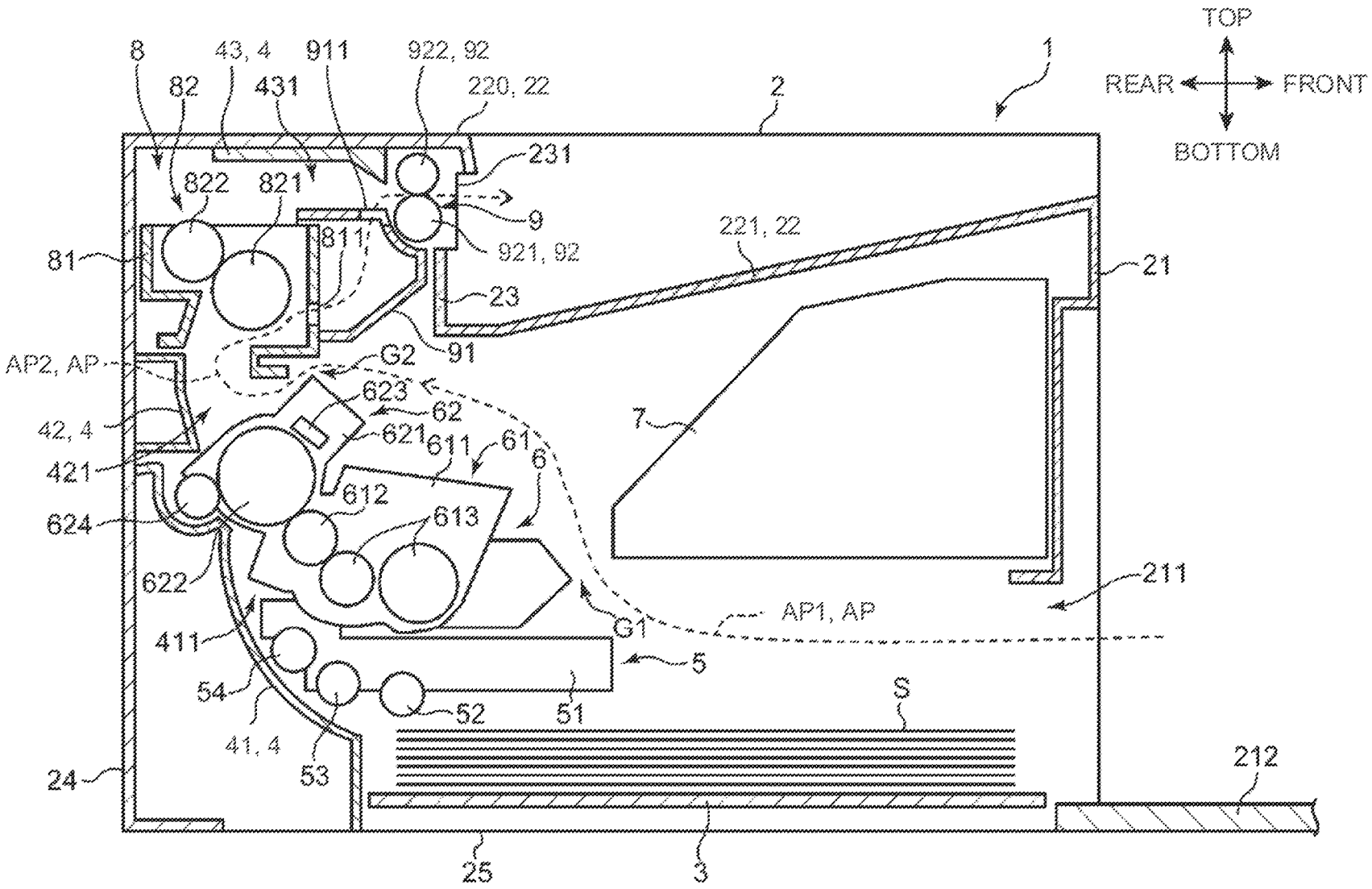
FIG. 2 is a cross-sectional diagram schematically illustrating the internal structure of the image forming apparatus.

FIG. 1 is a perspective diagram illustrating an image forming apparatus 1 according to an embodiment of the disclosure. FIG. 2 is a cross-sectional diagram schematically illustrating the internal structure of the image forming apparatus 1. The image forming apparatus 1 illustrated in FIGS. 1 and 2 is a monochrome printer. However, the image forming apparatus 1 in other embodiments may be a color printer, a facsimile machine, a multifunction machine that can function as a color printer or a facsimile machine, or any other device for forming toner images on a sheet.

The image forming apparatus 1 includes multiple units disposed inside a casing 2. The casing 2 has a front wall 21 and a rear wall 24 facing each other in the front-back direction; a top wall 22 and a bottom wall 25 facing each other in the up-down direction; a left wall 26 and a right wall 27 facing each other in the left-right direction; and a stepped wall 23. The casing 2 has a rectangular box shape as a whole. The top wall 22 has a rectangular planar shape extending in the left-right direction and the front-back direction, and defines a top face of the casing 2. The bottom wall 25 has a rectangular planar shape extending in the left-right direction and the front-back direction, and defines the bottom face of the casing 2. The front wall 21 has a rectangular planar shape extending in the up-down direction and the left-right direction. The front wall 21 connects the forward edge of the top wall 22 and the forward edge of the bottom wall 25, and is a side wall that defines the front face of the casing 2. The rear wall 24 has a rectangular planar shape extending in the up-down direction and the left-right direction. The rear wall 24 connects the rearward edge of the top wall 22 and the rearward edge of the bottom wall 25, and is a side wall that defines the rear face of the casing 2. The left wall 26 has a rectangular planar shape extending in the up-down direction and the left-right direction. The left wall 26 connects the leftward edge of the top wall 22 and the leftward edge of the bottom wall 25, and is a side wall that defines the left face of the casing 2. The right wall 27 has a rectangular planar shape extending in the up-down direction and the left-right direction. The right wall 27 connects the rightward edge of the top wall 22 and the rightward edge of the bottom wall 25, and is a side wall that defines the right face of the casing 2.

The front wall 21 has a first opening 211 below the center along the up-down direction. The first opening 211 is disposed between the two ends along the left-right direction of the front wall 21. Sheets S can be inserted into and removed from the casing 2 through the first opening 211. An openable tray 212 that opens and closes the first opening 211 is supported on the front wall 21. During image forming on a sheet S by the multiple units arranged inside the casing 2 as described below, the openable tray 212 opens the first opening 211.

The top wall 22 has a top face 220 and a sheet output portion 221. The top face 220 is connected to the top edges of the front wall 21, the rear wall 24, the left wall 26, and the right wall 27. The sheet output portion 221 is recessed from the top face 220 and extends in the front-back direction. The sheet output portion 221 has a tilting surface that tilts downward from the central portion along the left-right direction of the top edge of the front wall 21 toward the rearward side along the front-back direction. The stepped wall 23 extends upward from the rear edge of the sheet output portion 221, which is remote from the forward edge near the front wall 21, and is connected to the top face 220. The stepped wall 23 has a second opening 231 that is disposed between the two ends along the left-right direction. The sheet S on which an image has been formed by the multiple units arranged inside the casing 2 is output from the second opening 231 to the sheet output portion 221.

The image forming apparatus 1 includes a sheet loading section 3, a transport guide 4, a transport unit 5, an image forming unit 6, an exposure unit 7, a fixing unit 8, and an output unit 9, as structures arranged inside the casing 2.

The sheet loading section 3 is disposed inside the casing 2 on the bottom wall 25 so as to face the first opening 211. The sheet loading section 3 includes a rectangular loading plate extending in the left-right and front-back directions. Sheets S introduced into the casing 2 through the first opening 211 are placed on the loading plate.

The transport guide 4 forms a transport path of the sheet S inside the casing 2. The transport guide 4 has a first transport guide wall 41, a second transport guide wall 42, and a third transport guide wall 43.

The first transport guide wall 41 has a wall portion extending in a curved manner from a section of the bottom wall 25 on the rearward side along the front-back direction to a central section of the rear wall 24 along the up-down direction so as to be disposed behind the sheet loading section 3 inside the casing 2. The first transport guide wall 41 forms a first transport path 411 for guiding the transport of a sheet S placed on the sheet loading section 3 to a photosensitive drum 622 of the image forming unit 6 described below. The second transport guide wall 42 is disposed on the rear wall 24 so as to be disposed between the image forming unit 6 and the fixing unit 8 inside the casing 2. The second transport guide wall 42 forms a second transport path 421 for guiding the transport of the sheet S that has passed through the photosensitive drum 622 to the fixing unit 8. The third transport guide wall 43 is disposed at a rearward portion along the front-back direction of the top wall 22 so as to be disposed above the fixing unit 8 inside the casing 2. The third transport guide wall 43 forms a third transport path 431 for guiding the transport of the sheet S that has passed through the fixing unit 8 to the second opening 231.

The transport unit 5 is disposed inside the casing 2 above the sheet loading section 3 and in front of the first transport guide wall 41 so as to face the first transport guide wall 41. The transport unit 5 is disposed adjacent to the bottom side of the image forming unit 6. The transport unit 5 feeds a sheet S placed on the sheet loading section 3 to the first transport path 411. The transport unit 5 includes a transport housing 51, a pickup roller 52, a sheet feed roller 53, and a registration roller 54. The rollers are rotatably supported by the transport housing 51.

The pickup roller 52 is supported by the transport housing 51 so as to be aligned with the leading edge (rearward edge) of the sheet S placed on the sheet loading section 3. The pickup roller 52 rotates to pulls out a sheet S from the sheet loading section 3. The sheet feed roller 53 is supported by the transport housing 51 so as to be disposed opposite the area at the most upstream end of the first transport guide wall 41 along the transport direction of the sheet S in 1. The sheet feed roller 53 feeds the sheet S pulled out of the sheet loading section 3 by the pickup roller 52 to the first transport path 411. The registration roller 54 is supported by the transport housing 51 so as to be disposed opposite the central area of the first transport guide wall 41 along the transport direction of the sheet S. The registration roller 54 has a function of correcting skewed transport of the sheet S. As a result, the position of the image to be formed on the sheet S is adjusted. The registration roller 54 transports the sheet S toward the image forming unit 6 in accordance with the timing of image formation by the image forming unit 6.

The image forming unit 6 is disposed above and behind the sheet loading section 3 inside the casing 2, and adjacent to the top side of the transport unit 5. The image forming unit 6 forms an image on the sheet S that is being transported on the first transport path 411 by the transport unit 5. The image forming unit 6 includes a developing section 61 and a drum section 62. In the image forming unit 6, the developing section 61 is disposed adjacent to the top side of the transport unit 5, and the drum section 62 is disposed behind and above the developing section 61.

The drum section 62 includes a drum housing 621, a photosensitive drum 622, a charger 623, and a transfer roller 624. The photosensitive drum 622 is rotatably supported by the drum housing 621. The charger 623 is disposed opposite to the top side of the photosensitive drum 622. The transfer roller 624 is disposed opposite to the bottom side of the photosensitive drum 622. The photosensitive drum 622 has a cylindrical shape. The photosensitive drum 622 has a surface on which an electrostatic latent image is formed, and also carries a toner image (developer image) corresponding to the electrostatic latent image on its surface. The charger 623 receives a specific voltage and substantially uniformly charges the surface of the photosensitive drum 622. The transfer roller 624 forms a transfer nip together with the photosensitive drum 622 to transfer the toner image carried on the photosensitive drum 622 to the sheet S.

The developing section 61 supplies toner (developer) to the surface of the photosensitive drum 622 on which the electrostatic latent image is formed. When the developing section 61 supplies toner to the photosensitive drum 622, the electrostatic latent image formed on the surface of the photosensitive drum 622 is developed (visualized). As a result, a toner image is formed on the surface of the photosensitive drum 622. The developing section 61 includes a box-shaped developing housing 611 in which toner is filled, and a developing roller 612 and an agitating screw 613 disposed inside the developing housing 611. The agitating screw 613 agitates and transports the toner inside the developing housing 611. The developing roller 612 is disposed opposite the photosensitive drum 622 and supplies toner to the photosensitive drum 622.

The exposure unit 7 is disposed above the sheet loading section 3, above the first opening 211, and in front of the image forming unit 6 in the casing 2. The exposure unit 7 irradiates the surface of the photosensitive drum 622 charged by the charger 623 with a laser beam. As a result, an electrostatic latent image corresponding to image data is formed on the surface of the photosensitive drum 622.

The fixing unit 8 is disposed inside the casing 2 above the drum section 62 (the photosensitive drum 622) of the image forming unit 6 and behind the stepped wall 23. The fixing unit 8 heats and fixes the toner image on the sheet S. The fixing unit 8 includes a box-shaped fixing housing 81 and a fixing member 82 housed in the fixing housing 81. The fixing member 82 includes a heating roller 821 and a pressure roller 822. The heating roller 821 melts the toner on the sheet S by heating. The pressure roller 822 causes the sheet S to come in tight contact with the heating roller 821.

The output unit 9 is disposed inside the casing 2 in front of the fixing unit 8 and between the fixing unit 8 and the stepped wall 23. The output unit 9 outputs the sheet S after image fixing by the fixing unit 8 from the second opening 231 formed in the stepped wall 23 to the sheet output portion 221. The output unit 9 includes a box-shaped output housing 91 and an output member 92 supported by the output housing 91. The output housing 91 is disposed adjacent to the forward side of the fixing housing 81 and supports the output member 92 from below. The output member 92, which includes a first output roller 921 and a second output roller 922, is supported by the output housing 91 so as to face the second opening 231. The first output roller 921 and the second output roller 922, which are aligned in the vertical direction to form a pair, rotates to output the sheet S on which the image has been fixed from the second opening 231 to the sheet output portion 221.

Figure 3:
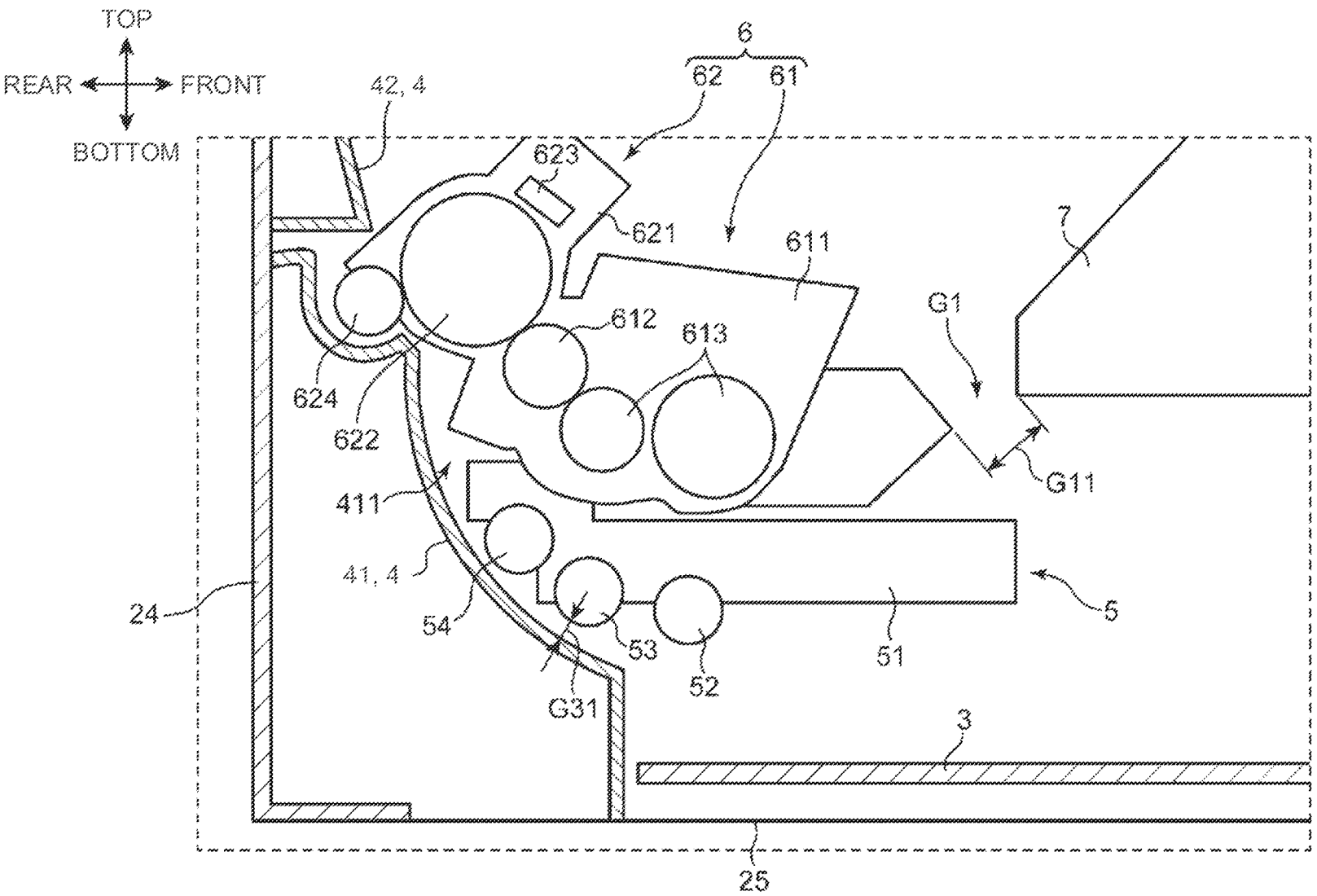
FIG. 3 is an enlarged cross-sectional diagram illustrating the vicinity of a transport unit, an image forming unit, an exposure unit disposed within a casing of the image forming apparatus.
Figure 4:
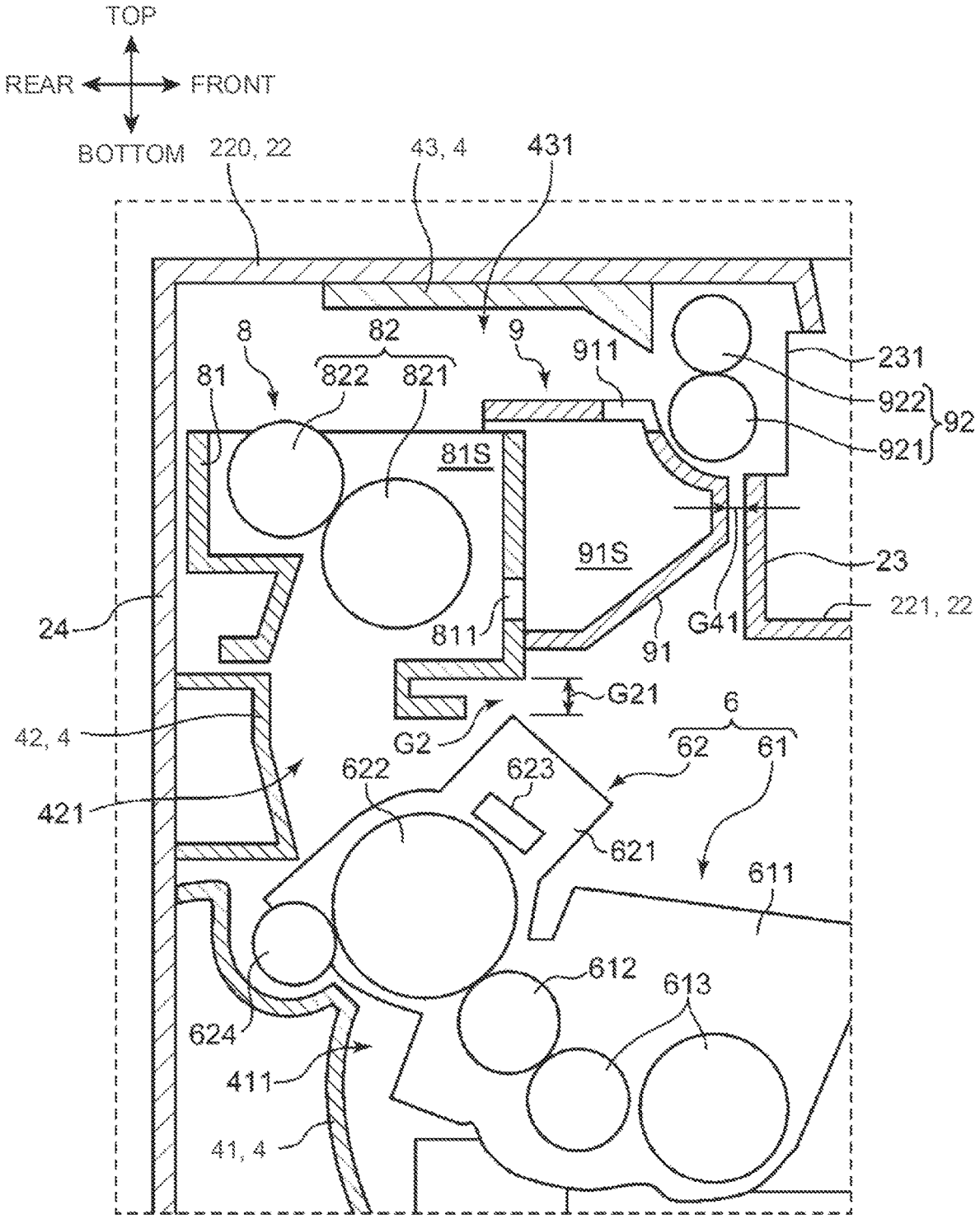
FIG. 4 is an enlarged cross-sectional diagram illustrating the vicinity of an image forming unit, a fixing unit, an output unit disposed in a casing of an image forming apparatus.
Figure 5:
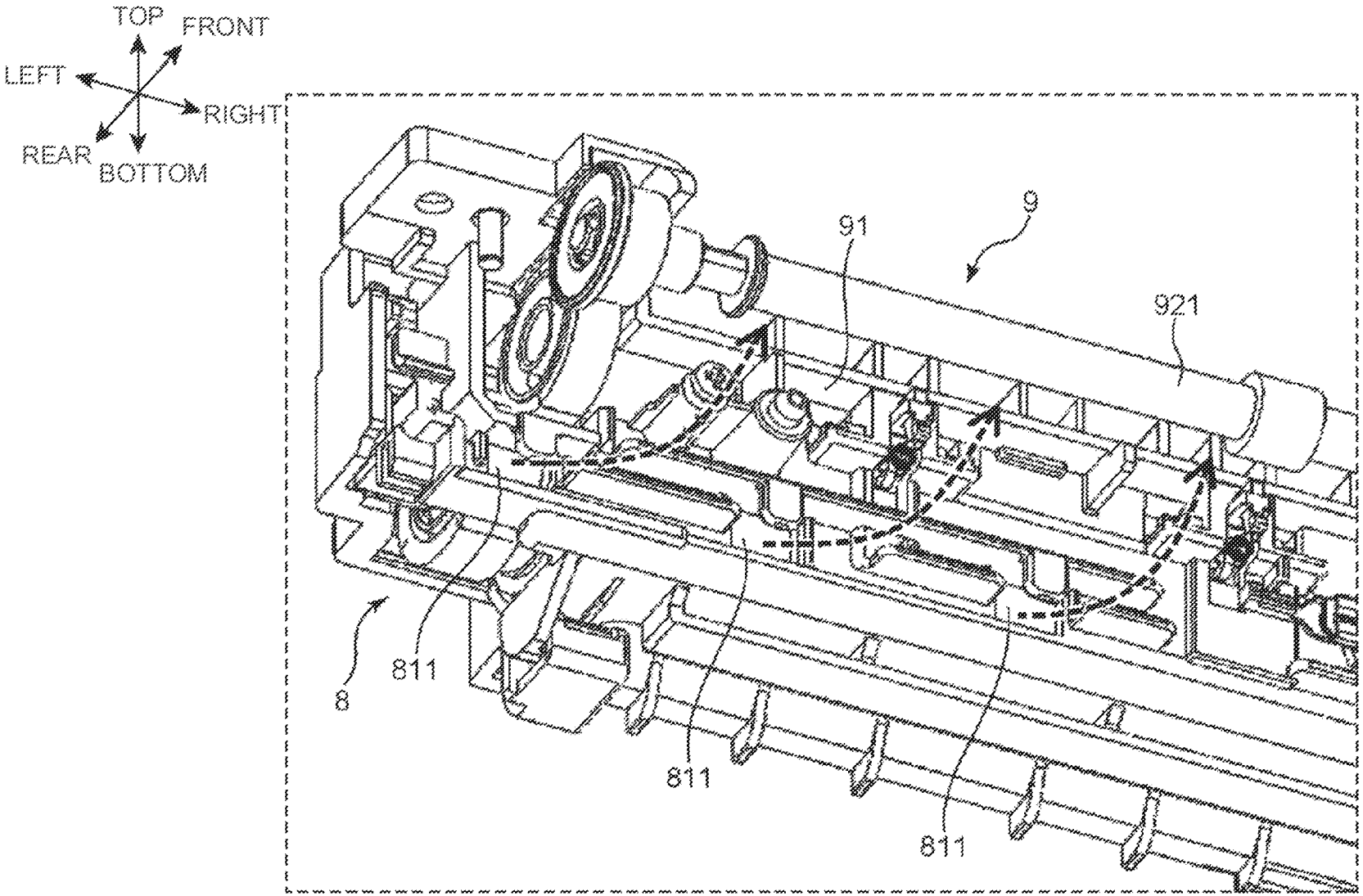
FIG. 5 is an enlarged perspective diagram illustrating the vicinity of the output unit disposed within the casing of the image forming apparatus.
Figure 6:
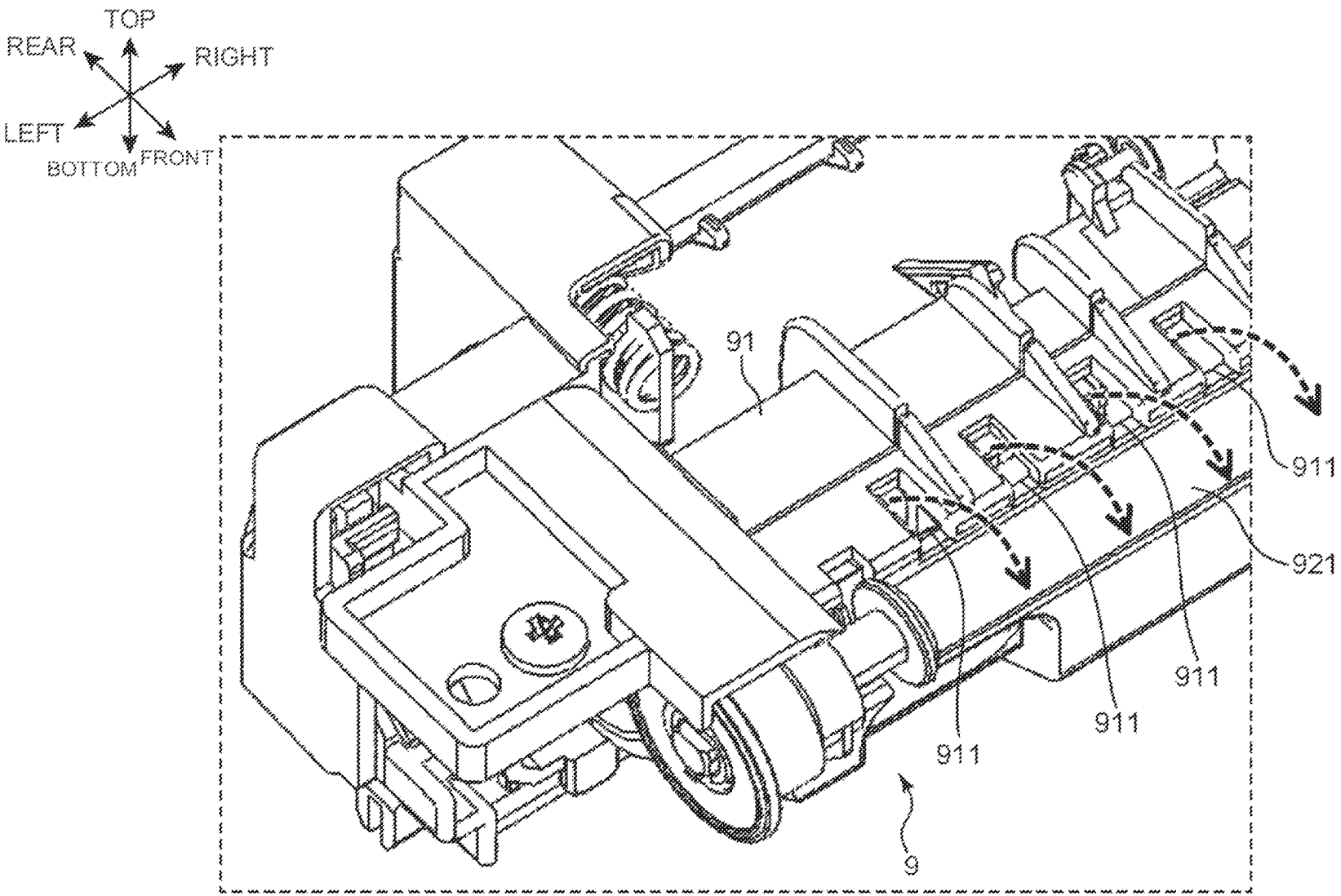
FIG. 6 is an enlarged perspective diagram illustrating the vicinity of the output unit disposed in the casing of the image forming apparatus.

The arrangement of the units inside the casing 2 will be described in further detail with reference to FIGS. 3 to 6 in addition to FIG. 2. FIG. 3 is an enlarged cross-sectional diagram illustrating the vicinity of the transport unit 5, the image forming unit 6, and the exposure unit 7 disposed inside the casing 2. FIG. 4 is an enlarged cross-sectional diagram illustrating the vicinity of the image forming unit 6, the fixing unit 8, and the output unit 9 disposed inside the casing 2. FIGS. 5 and 6 are enlarged perspective diagrams illustrating the vicinity of the output unit 9 disposed inside the casing 2.

As illustrated in FIG. 3, the exposure unit 7 is disposed with a specific first gap G1 between the exposure unit 7 and the image forming unit 6. Specifically, the first gap G1 is formed between the most rearwardly and downwardly located portion of the exposure unit 7, which is a portion closest to the image forming unit 6, and the most forwardly located portion of the image forming unit 6, which is a portion closest to the exposure unit 7. The gap width G11 of the first gap G1 is set to permit the passage of outside air flowing into the casing 2 through the first opening 211.

As illustrated in FIG. 4, the fixing unit 8 is disposed with a specific second gap G2 between the fixing unit 8 and the image forming unit 6. Specifically, the second gap G2 is formed between the most forwardly and downwardly located portion of the fixing unit 8, which is the portion closest to the image forming unit 6, and the most upwardly located portion of the image forming unit 6, which is the portion closest to the fixing unit 8. The gap width G21 of the second gap G2 is set to permit the passage of outside air flowing into the casing 2 through the first opening 211 and passing through the first gap G1.

In the casing 2 in which the multiple units including the transport unit 5, the image forming unit 6, the exposure unit 7, the fixing unit 8, and the output unit 9 are disposed, the first gap G1 and the second gap G2 constitute a ventilation channel AP that distributes outside air flowing through the first opening 211 to the second opening 231 (see FIG. 2). The ventilation channel AP include a first ventilation sub-channel AP1 and a second ventilation sub-channel AP2.

The first ventilation sub-channel AP1 is a distribution channel of outside air from the first opening 211 to the second gap G2 through the first gap G1. The section of the first ventilation sub-channel AP1 between the first opening 211 and the first gap G1 is defined by the space enclosed by the bottom face of the exposure unit 7, the top face of the sheet S placed on the sheet loading section 3, the left wall 26, and the right wall 27. The section of the first ventilation sub-channel AP1 between the first gap G1 and the second gap G2 is defined by the space enclosed by the image forming unit 6, the exposure unit 7, the sheet output portion 221 (the top wall 22), the output unit 9, the left wall 26, and the right wall 27. The second ventilation sub-channel AP2 is a distribution channel of outside air from the second gap G2 to the second opening 231 through the fixing unit 8 and the output unit 9.

The outside air flowing into the casing 2 through the first opening 211 flows along the first ventilation sub-channel AP1 and then along the second ventilation sub-channel AP2, and is finally output from the second opening 231 to outside the casing 2. Specifically, the outside air flowing into the casing 2 through the first opening 211 flows between the exposure unit 7 and the sheet S placed on the sheet loading section 3, passes through the first gap G1, and flows along the image forming unit 6 after passing through the first gap G1. The outside air flowing along the image forming unit 6 passes through the second gap G2. After passing through the second gap G2, the outside air flows through the fixing unit 8 and the output unit 9 toward the second opening 231. The flow of the outside air flowing into the casing 2 through the first opening 211 enables effective cooling of the units disposed in the casing 2, such as the exposure unit 7, the image forming unit 6, and the fixing unit 8. Consequently, there is no need to install a cooling fan and a duct for cooling the inside of the casing 2. For this reason, it is possible to reduce the size of the image forming apparatus 1.

Furthermore, since a cooling fan is not installed, no noise associated with the driving of the cooling fan is generated, and ozone, volatile organic compounds (VOC), ultrafine particles (UFP), and the like existing in the casing 2 can be prevented from being forcibly exhausted outside the casing 2 by the driving of a cooling fan. Note that ozone is generated by high-voltage discharge of the charger 623. VOC are generated by the heat generated in the fixing unit 8. UFP are generated by ionization of a portion of toner, paper powder, or the like floating around the photosensitive drum 622 by ozone, or by cooling and condensing of substances having a high boiling point contained in the toner or the like into fine particles.

As illustrated in FIG. 3, it is desirable that the gap width G11 of the first gap G1 be wider than the gap width G31 between the transport unit 5 and the first transport guide wall 41. The gap width G31 is the width of the gap formed between the sheet feed roller 53, which is disposed in the transport unit 5 opposite an area of the first transport guide wall 41 at the most upstream end in the transport direction of the sheet S, and the first transport guide wall 41. By setting the gap width G11 of the first gap G1 to such a width, the outside air flowing into the casing 2 through the first opening 211 and between the exposure unit 7 and the sheet S placed on the sheet loading section 3 is restricted from passing between the transport unit 5 and the first transport guide wall 41, and mainly passes through the first gap G1.

As illustrated in FIG. 4, it is desirable that the gap width G21 of the second gap G2 be wider than the gap width G41 between the output unit 9 and the stepped wall 23. The gap width G41 is the width of the gap formed between the stepped wall 23 and the most forwardly located portion of the output housing 91 of the output unit 9, which is the portion closest to the stepped wall 23. By setting the gap width G21 of the second gap G2 to such a width, the outside air flowing along the image forming unit 6 after passing through the first gap G1 is restricted from passing between the output unit 9 and the stepped wall 23, and mainly passes through the second gap G2.

As illustrated in FIG. 4, the fixing housing 81 of the fixing unit 8 has a fixing housing space 81S that is an internal space of the fixing housing 81. The output housing 91 of the output unit 9 has an output support internal space 91S that is an internal space of the output housing 91. The fixing housing 81 has fixing-side connecting openings 811 that connect the fixing housing space 81S to the output support internal space 91S. Multiple fixing-side connecting openings 811 are provided in the face of the fixing housing 81 opposite the output housing 91 at specific intervals in the left-right direction, as illustrated in FIG. 5. The output housing 91 has output-side connecting openings 911 that connect the output support internal space 91S to the second opening 231. Multiple output-side connecting openings 911 are provided in the top face of the output housing 91 at specific intervals in the left-right direction, as illustrated in FIG. 6.

The fixing-side connecting openings 811 and the output-side connecting openings 911 constitute the second ventilation sub-channel AP2 as openings for distributing outside air that has passed through the second gap G2 to the second opening 231. The outside air that flows into the casing 2 through the first opening 211 and passes through the first gap G1 and the second gap G2 flows from the fixing-side connecting openings 811 into the output support internal space 91S of the output housing 91 through the fixing housing space 81S of the fixing housing 81. The outside air flowing into the output support internal space 91S flows out from the output support internal space 91S through the output-side connecting openings 911 and is exhausted from the second opening 231 to outside the casing 2. Such flow of the outside air into the casing 2 through the first opening 211 enables effective cooling of the inside of the casing 2.

What is claimed is:

1. An image forming apparatus comprising:

a casing comprising:

a side wall extending in an up-down direction and a first horizontal direction and having a first opening; a top wall comprising a top face and a sheet output portion, the top face connected to a top edge of the side wall, the sheet output portion being recessed from the top face and extending in a second horizontal direction orthogonal to the first horizontal direction; and a stepped wall extending upward from an edge of the sheet output portion on one side along the second horizontal direction, being connected to the top face, and having a second opening, the one side being opposite another side adjacent to the side wall;

a sheet loading section on which a sheet is placed, the sheet loading section being disposed in the casing facing the first opening and extending in the first horizontal direction and the second horizontal direction;

an image forming unit disposed in the casing above the sheet loading section and on the one side along the second horizontal direction, the image forming unit including a photosensitive drum for forming an image on the sheet;

an exposure unit disposed in the casing at a position above the sheet loading section and above the first opening, on the other side of the image forming unit along the second horizontal direction with a specific first gap between the image forming unit and the exposure unit, the exposure unit irradiating the photosensitive drum with light; and a fixing unit disposed in the casing above the image forming unit and on the one side of the stepped wall along the second horizontal direction, with a specific second gap between the image forming unit and the fixing unit, the fixing unit heating and fixing an image on the sheet, wherein the first gap and the second gap are set to a gap width that permits passage of outside air flowing into the casing through the first opening, and the first gap and the second gap constitute a ventilation channel that distributes the outside air to the second opening.

2. The image forming apparatus according to claim 1, further comprising:

a transport guide wall disposed in the casing on the one side of the sheet loading section along the second horizontal direction, the transport guide wall forming a transport path of the sheet placed on the sheet loading section;

a transport unit disposed in the casing above the sheet loading section and on the other side along the second horizontal direction of the transport guide wall, adjacent to a bottom side of the image forming unit, the transport unit feeding the sheet placed on the sheet loading section to the transport path; and an output unit disposed in the casing between the fixing unit and the stepped wall and outputs the sheet after image fixing by the fixing unit, from the second opening to the sheet output portion, wherein, a gap width of the first gap is set to be wider than a gap width between the transport unit and the transport guide wall, and a gap width of the second gap is set to be wider than a gap width between the output unit and the stepped wall.

3. The image forming apparatus according to claim 2, wherein, the fixing unit includes a fixing member and a fixing housing having a fixing housing space housing the fixing member, the output unit includes an output member disposed facing the second opening and an output housing having an output support internal space, the output housing supporting the output member from below, the output member being disposed adjacent to the fixing housing, the fixing housing has a fixing-side connecting opening connecting the fixing housing space to the output support internal space of the output housing, the output housing has an output-side connecting opening connecting the output support internal space to the second opening, and the fixing-side connecting opening and the output-side connecting opening constitute the ventilation channel as an opening distributing the outside air passing through the second gap to the second opening.

* * * * *